United States Patent [19]

Laapotti

[11] Patent Number: 4,576,682

[45] Date of Patent: Mar. 18, 1986

[54] LONG-NIP PRESS FOR A PAPER MAKING MACHINE

[75] Inventor: Jorma Laapotti, Palokka, Finland

[73] Assignee: Valmet Oy, Finland

[21] Appl. No.: 590,951

[22] Filed: Mar. 19, 1984

[30] Foreign Application Priority Data

Mar. 23, 1983 [FI] Finland ..... 830995

[51] Int. Cl.[4] ..... D21F 3/06

[52] U.S. Cl. ..... 162/358; 162/205; 162/360.1; 100/156; 100/210

[58] Field of Search ..... 162/205, 358, 360.1; 100/156, 210, 118, 121, 151

[56] References Cited

U.S. PATENT DOCUMENTS

| | | | |
|---|---|---|---|
| 3,970,515 | 7/1976 | Busker | 162/205 |
| 4,201,624 | 5/1980 | Mohr et al. | 162/205 |
| 4,287,021 | 9/1981 | Justus et al. | 162/205 |
| 4,464,226 | 8/1984 | Karvinen | 162/358 |
| 4,468,287 | 8/1984 | Dahl | 100/118 |

*Primary Examiner*—S. Leon Bashore
*Assistant Examiner*—Andrew J. Anderson
*Attorney, Agent, or Firm*—Steinberg & Raskin

[57] ABSTRACT

An improvement in a long-nip press for a paper making machine, and a method for applying pressure in the press zone of such a long-nip press. The improvement is directed to providing a press shoe arrangement in the press nip that comprises a frame component, means for articulately engaging the frame component with a stationary structure, a first shoe component disposed in the frame component with means for applying pressure to the same, a second shoe component formed as a part of the frame component itself along with means for applying pressure to the same, with the press shoe arrangement constituting means for incrementally increasing pressure on a press belt and in the press zone itself. The method of the present invention is directed to applying pressure on a running fibrous web through a press nip, by incrementally applying greater and greater pressure onto the running fibrous web as it passes through the press nip.

8 Claims, 9 Drawing Figures

LONG-NIP PRESS FOR A PAPER MAKING MACHINE

BACKGROUND OF THE INVENTION

The present invention is directed to a long-nip press for a paper machine or cardboard machine, and to a method for dewatering a fibrous web, such as a paper web, passing through such a long-nip press.

More specifically, the present invention is directed to a long-nip press for a paper machine or a cardboard machine, in which the press zone is formed between a counter-roll and a press-shoe arrangement, or between a counter-shoe and the press-shoe arrangement. The web of fibre such as paper passes through this press zone between two press belts, or between a felt and a single press belt. The press-shoe arrangement is located inside the loop of the press belt, with the press including means for hydrodynamically lubricating the press belt by feeding lubricant onto an inside face of this press belt before the press zone. The press also includes means for recovering the lubricant, by collecting as much of the lubricant as possible after the press zone.

It is commonly known in the prior art to remove water out of fibrous webs, such as from paper or cardboard webs, by passing such a web through a press nip formed by two rolls disposed opposite one another. As known in the prior art, one or two press fabrics are passed through such dewatering nips, these press fabrics carrying water removed out of the fibrous web, and also acting to convey the fibrous web forwardly.

As the production rate of such paper machines increases, the dewatering performed by means of such nip pressing has become an obstacle limiting increase of speed of paper production. This is due to the fact that the press nip is formed by a pair of rolls having a short pressing area, so that the residence time of a running fibrous web in these nips is very short at very high speeds of operation. However, due to the flow resistance of the fibrous structure of the web itself, water requires a minimum amount of time for escaping out of the web into the hollow face of a press roll or into a press fabric, in a dewatering operation.

Several press nips have been used for dewatering as disclosed in the prior art, examples of which include the so-called "Sym-Press" press section, or several separate, individual, successive press nips. However, the use of successive press nips requires a relatively large area for operation, especially if separate, individual press nips are used one right after the other. Compact construction of press sections however, such as the "Sym-Press" press section, cause difficulty in obtaining optimal positioning of the various components, as well as creating difficulties in the operation of the press itself, such as in the removal of paper broke. In nip presses, suction rolls are commonly used which are relatively expensive components and which consume a tremendous amount of suction energy and cause noise. In suction rolls, a perforated mantle must be used, which causes problems with the mechanical strength of such suction rolls.

If an attempt is made to increase dewatering output in nip presses by increasing the nip pressure, a certain limiting line pressure value is reached, beyond which any increase in the line pressure is no longer helpful because the structure of the fibrous web and of the press fabrics can no longer withstand the increased compression pressure.

Attempts have been made to lengthen the area of roll nips contacted by the web to be dewatered, by using rolls of larger diameter and by using soft press fabric, but even with utilization of these features, a limit in terms of feasible economic application is soon reached.

In order to solve the problems noted above in addition to other problems, so-called long-nip presses have been developed in recent years. Such types of presses are disclosed, for example, in U.S. Pat. Nos. 3,808,092; 3,808,096; 3,840,429; 3,970,515; 4,201,624; and 4,229,253, as well as in GB Pat. Appln. No. 2,057,027.

Further prior art press constructions are disclosed in FI Pat. Appln. No. 3,554/72 and in U.S. Pat. No. 3,783,097, both assigned to Beloit Corporation, U.S.A. In the former document, a press construction for a paper machine is disclosed for pressing water out of a paper web by the use of flexible belts, and by achieving a long press zone by tensioning these flexible belts. However, a drawback of this particular long-nip press is that mechanical strength of the press felts and of the concomitant guide rolls, imposes a restriction on the generation of sufficiently high compression, needed to obtain efficient dewatering.

In U.S. Pat. No. 3,783,097, a long-nip press is disclosed in which several subsequent pressure shoes are utilized, the pressure shoes being pressed towards an opposing belt and press roll. A drawback of the construction disclosed in this reference is that the friction between the pressure shoes and the opposing belt causes a tremendous consumption of energy, with the belt and the press shoes being subjected to intensive wear-and-tear due to the rubbing.

In U.S. Pat. No. 3,840,429, a long-nip press is described in which the web to be pressed linearly runs between two felts through a press zone formed by two opposing press shoes, and generated by means of a pressure medium. Moreover, bands are disposed inside the loops of the felts, to define the press zones and transmit the pressure of the medium to the web. However, problems of sealing of the press zone occur in this particular type of long-nip press, with the patent not suggesting any solution.

Another drawback of this construction is that the web is immediately subjected to full and necessarily relatively high compression pressure. However, since a web has a low dry-solid content, this web will not withstand an initial pressure of compression greater than a certain limit, without breaking. Thus, the compression pressure in a long-nip press of U.S. Pat. No. 3,840,429, must be kept relatively low. In view of the fibrous structure of the running web, it is disadvantageous to immediately use suddenly-increasing, high compression pressures as the initial pressure of compression in a press nip.

SUMMARY OF THE INVENTION

Accordingly, in view of the foregoing, it is an object of the present invention to provide a new and improved long-nip press, and a new and improved method of dewatering a running fibrous web such as a paper web, in which the drawbacks noted above concerning the prior art are successfully avoided.

It is another object of the present invention to provide a new and improved long-press nip and method of dewatering a running fibrous web, in which a greater amount of compression can be directed onto the web itself, so that a drier web will be achieved, and use of higher production speeds will be possible.

It is thus a further object of the present invention to provide a new and improved long-nip press and method of dewatering a paper web, which permits increased output of production of the paper machine in which the long-press nip is so situated.

It is also a further object of the present invention to provide a new and improved long-nip press and method for dewatering a fibrous web, in which energy consumption can be held to a minimum.

It is even a further object of the present invention to provide a new and improved long-nip press and method of dewatering a fibrous web, in which it is possible to adjust distribution of compression pressure within such a press nip over a wide range of values, to make optimal use of the method of pressing and of dewatering the running fibrous web. In regard to this last-noted object, attention is called to U.S. Pat. No. 3,783,097, and to corresponding U.S. Pat. No. Re.30,268, assigned to Beloit Corporation. The prior art long-nip presses disclosed in these documents result in exactly the same previously-encountered drawbacks in that distribution of compression pressure within the corresponding press nips cannot be feasibly adjusted.

These and other objects of the present invention will become apparent from the following description thereof, with reference to the accompanying drawings.

These and other objects are attained by the present invention, which provides for an improvement in a long nip press, in which a press zone is formed between a counter-roll and a press-shoe arrangement or between a counter-shoe and the press-shoe arrangement, through which press zone a fibrous web passes between a felt and a press belt or between two press belts with the press shoe arrangement being disposed inside a loop of the press belt, and said press including means for hydrodynamically lubricating the press belt by feeding lubricant thereon before the press zone, and means for recovering lubricant off the press belt after the press zone, the improvement comprising said press shoe arrangement comprises a frame component, means for articulately engaging said frame with a stationary structure, a first shoe component disposed in said frame component, means for applying pressure to said first shoe component and disposed between said first shoe component and said frame component so that said first shoe component can be loaded to a particular pressure, a second shoe component formed as part of said frame component, means for applying pressure to said second shoe component to load the same, and said press shoe arrangement constituting means for increasing pressure in the press zone in one or more discrete increments in the running direction of the web.

More particularly, the improvement of the present invention comprises said articulately engaging means extends substantially transversely to the running direction of the web, the means for applying pressure to the second shoe component comprises at least one movable cylinder disposed between the frame component and the stationary structure, and the press shoe arrangement also constitutes means for rapidly lowering pressure in the press zone from the maximum pressure so attained in the press zone to substantially no pressure at all.

The present invention also provides for a method of dewatering a running fibrous web such as a paper web in a press nip. The present invention is directed to a method for applying pressure to a running fibrous web in a press nip, which comprises incrementally applying greater and greater pressure onto the running web as it passes through the press nip. Such a method also comprises the step of rapidly releasing all pressure applied to the running fibrous web after the maximum amount of pressure has been applied thereto within the press nip.

One specific embodiment of the present invention is principally characterized by a press shoe arrangement comprising a frame portion which is attached to a stationary structure such as a pedestal of the press section, by way of an articulated shaft transverse to the direction of running of the fibrous web;

a first shoe component is provided in the frame portion, with means for creating a pressure medium being disposed between the first shoe component and the frame portion, so that the first shoe component can be loaded and pressed against the running web, a second shoe component is disposed immediately after the first shoe component and is formed as a part of the frame portion of the press shoe arrangement, with means for loading this second shoe component, preferably in the form of at least one or a set of loading cylinders, being disposed between the stationary structure of the press and the frame portion of the press shoe arrangement, and the press shoe arrangement constitutes means for increasing the compression pressure applied to the press nip in one or several increments in the direction of the running of the web, as well as constituting means for lowering the maximum compression pressure to substantially zero pressure within a relatively short interval.

Another specific embodiment of the present invention is directed to an improvement in the long-nip press noted above, the improvement comprising:

said press shoe arrangement comprises a stationary frame component and at least two individual shoe components disposed in the frame component, and spaced a short distance from one another in a running direction of the web, the shoe components being adapted to be pressed against the press belt to constitute means for increasing pressure in the press zone in one or more discrete increments in the running direction of the web.

This specific embodiment of the present invention is principally characterized in that the press shoe arrangement comprises a stationary frame portion attached to a structure of the press, with the frame portion comprising at least two component shoes spaced at a small distance from one another. These shoe components are in the form of sealed, rib-shaped pistons fitted into grooved spaces in the frame portion, with opposite projecting portions of the pistons being disposed at a small distance from one another. These component shoes can be loaded against the press belt by means of pressure, with each shoe component being independently adjustable from the another, so that a stepwise, incremental distribution of the compression pressure can be obtained.

BRIEF DESCRIPTION OF THE DRAWINGS

The present invention will be described in detail with reference to exemplifying embodiments illustrated in the figures of the accompanying drawings, the present invention not being strictly confined to the specifics of the exemplary embodiments described herein. In the accompanying drawings

DETAILED DESCRIPTION OF THE PREFERRED EMBODIMENTS

Figure 1:
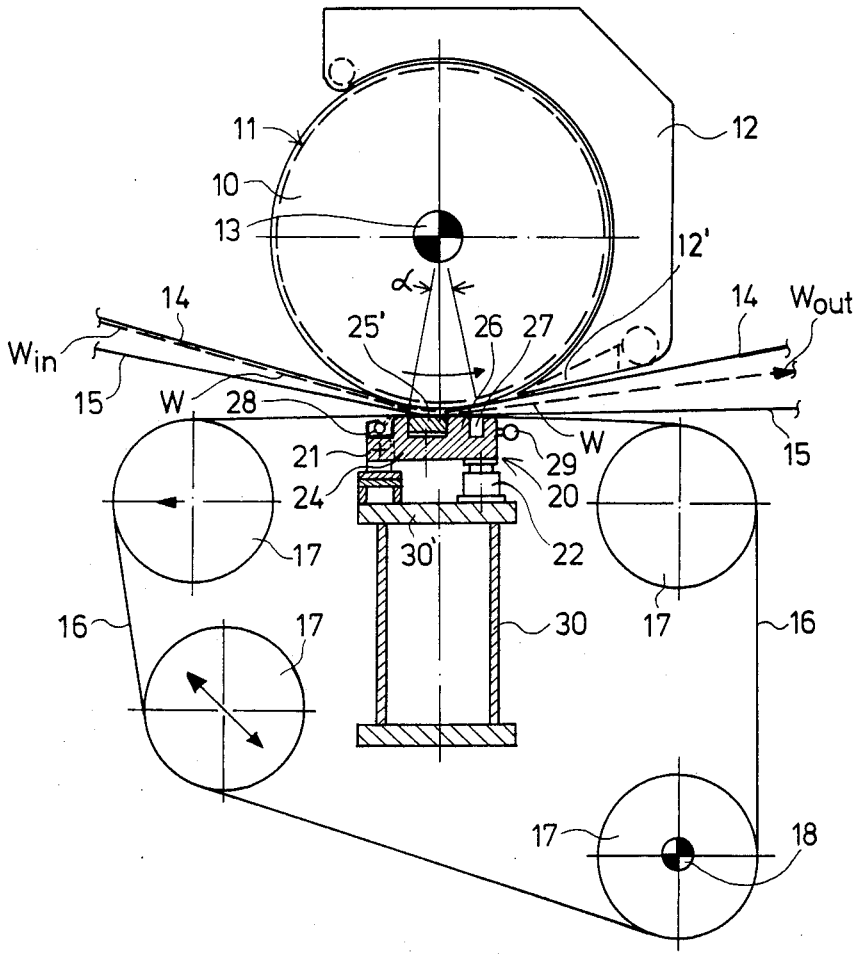
FIG. 1 is a schematic side view representation of an overall long-press nip arrangement in accordance with the present invention.

Referring to the drawings, according to FIG. 1, a paper web W is pressed against a roll 10 by means of a press shoe 20. The press zone extends over the surface of the roll 10 within the area of its center angle $\alpha$. The counter-roll 10 is provided with a hollow face 11, and is also provided with drive means 13. At the outlet side of the roll 10, in the direction of running of the web W, a water-collecting trough 12 is disposed, with a wedge portion 12' extending as close to the press zone $\alpha$ as possible. Arrival of the web W in the press zone $\alpha$ is denoted with reference character $W_{in}$, and the corresponding exiting of the web W from the press zone $\alpha$ is denoted with reference character $W_{out}$. The web W runs through the press zone $\alpha$ between press felts 14 and 15. The web W is introduced into the press zone on the upper felt 14. After passing through the press zone$\alpha$, the web W is preferably detached from the felts 14 and 15 as soon as possible, in order to prevent rewetting of the web W by water contained on these felts.

Compression pressure of a press shoe 20 is directed onto the web W by the intermediately-disposed felt 15 through an impervious press belt 16. Belt 16 runs as guided by guide rolls 17, at least one of these guide rolls 17 preferably being provided with drive means 18. A lower felt 15 disposed between the web W and the belt 16 is not always required; belt 16 may be provided with a coating designed to contact the web W, so that this coating layer absorbs water from the web W and carries the same away. In any event, belt 16, as a whole, is impervious.

Figure 2:
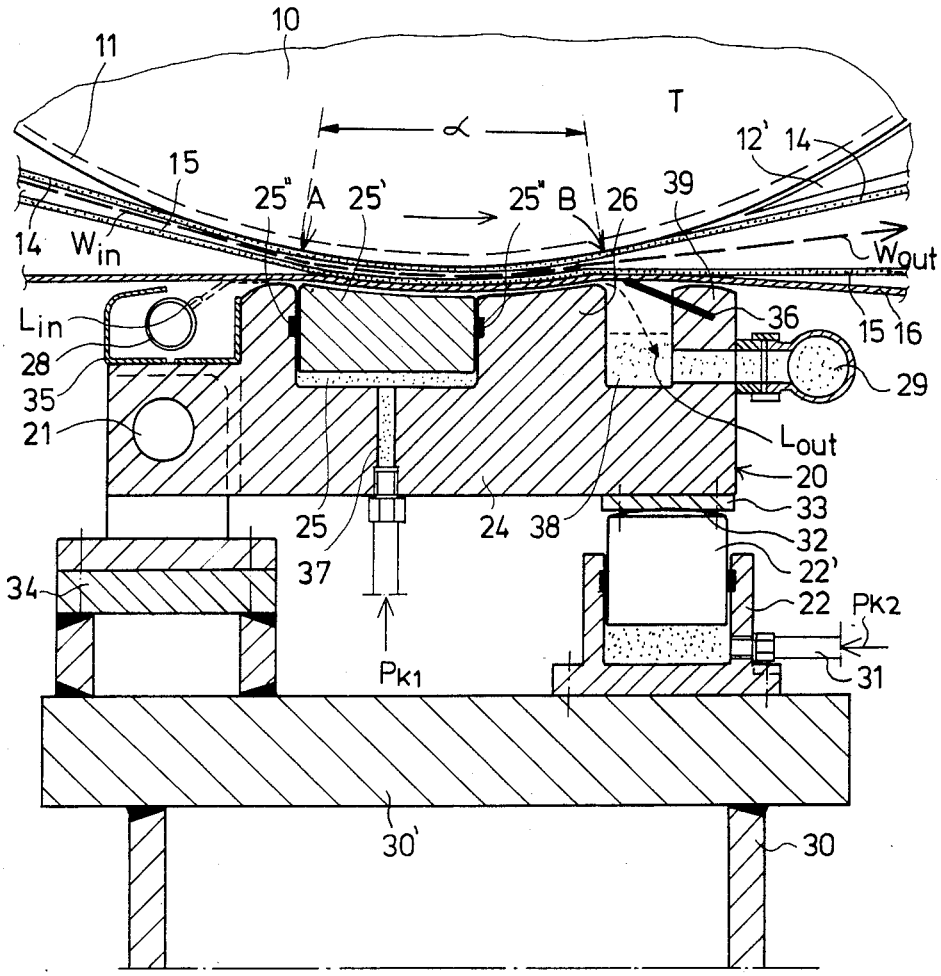
FIG. 2 is a cross-sectional view of a press zone of this long-nip press.

FIG. 2 illustrates a more detailed view of the structure of the press shoe 20 illustrated in FIG. 1. Compression pressure within the press zone $\alpha$ is produced by way of two shoe components 25' and 26 of the shoe 20. The latter shoe component 26 forms a fixed part of frame portion 24 of the press shoe 20, the frame portion 24 also being provided with a grooved space 25 for the rib-shaped, first shoe component 25'. The shoe component 25' is preferably piston-like and is provided with seals 25'' as illustrated in FIG. 2. Shoe component 25' may be disposed on another piston-like arrangement, which is, in turn, disposed in space 25.

The frame portion 24 of shoe 20, is, at its forward location, attached to a stationary lower frame 30 of the press, by way of an articulated joint 21 extending transverse to the direction of the running of the web W, and through the intermediate part 34 of frame 30. The first shoe component 25' can be loaded or pressured in relation to the frame portion 24 and to the stationary second shoe component 26, by means of a pressure medium and a pressure $P_{k1}$, the pressure medium being passed through channel 37 into space 25 underneath the piston-like first shoe component 25'.

The second shoe component 26 is pressured or loaded by the piston 22' of the loading cylinder 22 contacting the frame portion 24, as illustrated in FIG. 2. Preferably, there are several loading cylinders 22 disposed in side-by-side relationship, transversely to the direction of the running of the web W. A pressure $P_{k2}$ is passed thereto, by way of intermediate pipes 31. The upper ends 32 of the pistons 22' are curved or rounded as illustrated, and rest against a plate portion 33 which is attached to the bottom side of the frame portion 24.

Both the first and second shoe components 25' and 26, are hydrodynamic press shoes. Lubricant is fed onto the lower face of the press belt 16 out of a pipe 28 provided with nozzles, this pipe extending in the transverse direction over the entire width of the press belt 16. Feeding of the lubricant is denoted by the reference character $L_{in}$ in FIG. 2. The feedpipe 28 for lubricant is disposed above the articulated joint 21 and inside a shield 35.

After the press zone $\alpha$, the lubricant is scraped off the inside or lower face of the press belt 16 by way of a doctor blade 36 disposed above the groove space 38 provided in the frame portion 24. After the groove space 38, a guide part 39 is provided on the frame portion 24, the top face of this guide part 39 guiding the running of the band or press belt 16. Groove space 38, which collects the lubricant removed from the lower side of belt 16 by doctor blade 36, is connected to an exhaust pipe 29 for lubricant by way of several channels. The removal of lubricant from the press zone and the concomitant recirculation thereof is denoted by reference character $L_{out}$.

The lubricant ($L_{in}$) is fed through the nozzle holes of pipe 28 into the gap between the lower face of the band or press belt 16 and the frame portion 24. The exhaust pipe 29 is connected with a pump device (not shown) for this recirculation of the lubricant to feedpipe 28.

Both of the first and second shoe components 25' and 26 in the embodiment illustrated in FIGS. 1 and 2, are hydrodynamically-lubricated shoes. Friction forces are transferred to the lower frame 30 through the intermediate, articulated joint 21. Hydrodynamic lubrication means that lubrication takes place by the effect of the movement of the band or press belt 16, and not by means of a positive pressure of the lubricant itself upon the band. Due to the hydrodynamic lubrication, the long-nip press is started with a relatively low compression pressure, and this compression pressure may be increased as the lubrication reaches an adequate level. Advantages of hydrodynamic lubrication are that difficulties of sealing of the lubricant are not encountered, while oozing of the lubricant along edges of the press belt 16 does not occur. The lubricant itself may be water, oil, semi-liquid fat, or a water-oil emulsion. The pressure medium producing the force of the shoe 25', and of the loading cylinders 22, is preferable an hydraulic oil, which is generated by way of known hydraulic pumps, for example pumps of adjustable volume.

Figure 3:
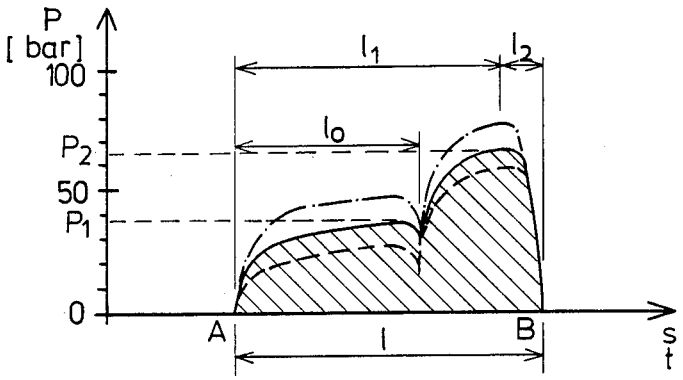
FIG. 3 is a graph illustrating the distribution of compression pressure within the press zone of the long-nip press of FIGS. 1 and 2.

FIG. 3 is a graph illustrating the distribution of compression pressures P in the press zone $\alpha$, the total length of the press zone being denoted by "1" along the axis of the graph as illustrated. This length "1" of the press zone is, for example, about 150 to 300 mm. From the starting line A of the press zone $\alpha$, the compression pressure P increases substantially exponentially to a certain level $P_1$ (for example, about 20 to 50 bar), up to the outgoing edge of the first shoe component 25' in the direction of the running of the web W. The length of the first shoe component 25' is denoted with the character "$\mathbf{1}_0$" in FIG. 3.

At the joint that occurs between the first and second shoe components 25' and 26, the compression pressure is briefly reduced, as illustrated in FIG. 3. However, due to the particular shaping of the second shoe component 26, and the pressure applied thereon through the cylinder 22 and piston 22', the compression pressure sharply increases to the peak pressure $P_2$, the magnitude of this particular pressure being within the range of about 50 to 80 bar, preferably about 60 to 80 bar (the pressure level $P_1$ is preferably about 20 to 40 bar). At the outlet edge of the second shoe component 26 in the direction of the running of the web W, within the distance denoted by "$\mathbf{1}_2$" on FIG. 3, the pressure is lowered quite steeply to zero pressure by the final line B of the press zone $\alpha$, denoted in FIGS. 1 and 2.

In FIG. 3, the overall pressure-increase area or distance in the press zone $\alpha$ is denoted by the line "$\mathbf{1}_1$", while the concomitant pressure-decrease area is denoted with the line "$\mathbf{1}_2$". The lengths of the distances $\mathbf{1}_1$ and $\mathbf{1}_2$, along with the ratio of these various lengths to one another, may be varied quite readily in accordance with the present invention, in order to obtain an optimal compression result. As a rule, the length of the pressure-increase area $\mathbf{1}_1$ is about 3 to 6 times as long as the length of the pressure-decrease area $\mathbf{1}_2$.

In accordance with FIG. 3, a stepwise-increasing compression pressure along the press zone $\alpha$ is achieved, which is extremely advantageous in view of the overall compression process and the dewatering of the fibrous web W that occurs, especially because dewatering can now be started cautiously with a relatively low compression pressure, and can be controlled so that it is increased at one or several discrete steps or increments as water is removed out of the web W and into the felts 14 and 15 and/or in the press belt 16. The structure of the fibrous running web W can therefore endure higher and higher compressure pressures within the press zone, without being broken. The maximum compression pressure $P_2$ substantially determines the ultimate humidity content of the running web W. Therefore, it is now possible to make this compression pressure $P_2$ as high as possible by this particular construction of the long-nip press, along with other factors.

When a long-nip press in accordance with the present invention is utilized in a dewatering operation, in which the distribution of the compression pressure is adjustable and in which it is possible to use an extremely high maximum compression pressure $P_2$ at the end of the press zone $\alpha$, in certain cases such as when thinner paper qualities are being produced, it is now possible to replace all roll nips by one single long nip, in accordance with the present invention. Thus in this regard, processing economy can also be achieved in terms of the overall space required by the press section.

In FIG. 3, the average distribution of compression pressure is illustrated by the solidly-plotted line, and by the diagonally-shaded area. This area illustrates the compression work performed within the press zone $\alpha$. The dashed curve plotted in FIG. 3 illustrates the minimum pressure applied along the press zone $\alpha$, while the dash-dot line illustrates the maximum pressure that might be applied along a press zone $\alpha$, in accordance with the present invention. Controlling of the compression pressure takes place, as noted above, by adjusting the pressures $P_{k1}$ and $P_{k2}$. Preferably, adjustment of one of these pressures $P_{k1}$ and $P_{k2}$, is carried out independent from any adjustment of the other pressure.

Adjustment of the overall shape of a compression pressure curve such as illustrated in FIG. 3, is required when different paper quality, or when paper or cardboard qualities of differing masses per square meter, are produced. It is also possible to adjust the width of the press zone, for example, so that the pressure $P_{k1}$ may be adjusted to zero, in which case the length of the overall press zone is shortened to only $\mathbf{1}_1$-$\mathbf{1}_0$.

A special advantage of the present invention is that it is now possible to control the overall moisture profile of the paper web W in the transverse direction thereof, by adjusting different pressures $P_{k2}$ for different loading cylinders 22 for the second shoe component 26. In this regard, it should be substantiated that the oblong and relatively slender frame portion 24 of the shoe 20 is not completely rigid in the transverse direction thereof.

Figure 4:
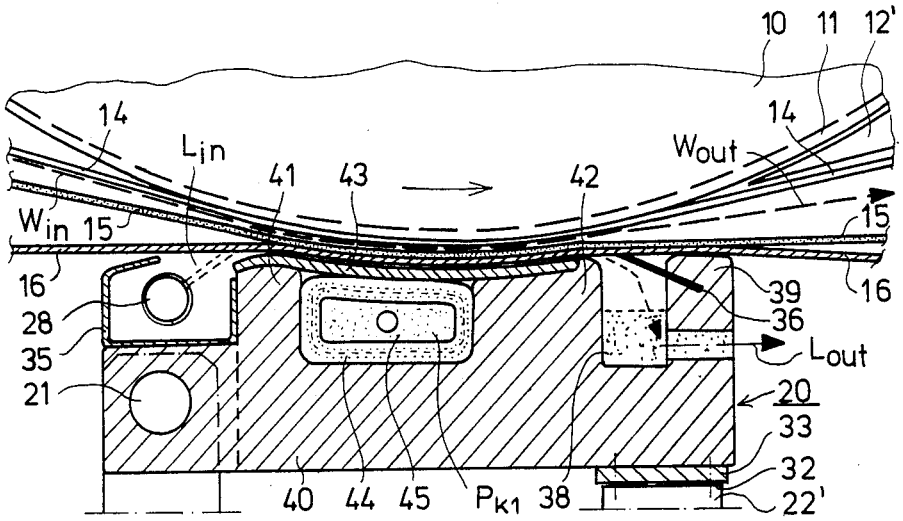
FIG. 4 illustrates another, alternative embodiment of a long-nip press in accordance with the present invention.
Figure 5:
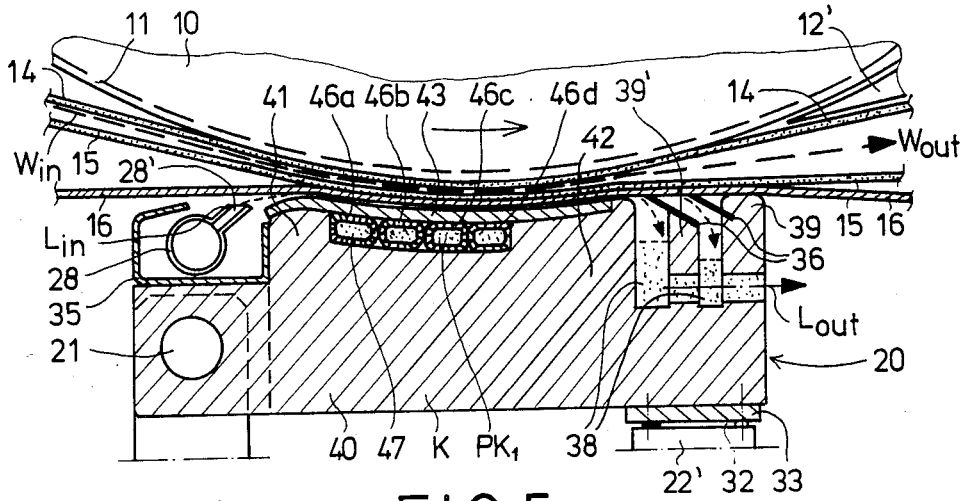
FIG. 5 illustrates a modification of the long-nip press of the present invention illustrated in FIG. 4.

The long-nip press embodiment illustrated in FIGS. 4 and 5 essentially operates in the same fashion as the embodiment illustrated in FIGS. 1–3 and described above. In the embodiment illustrated in FIG. 4, the first shoe component 25' illustrated in FIGS. 1 and 2 is substituted with a pressure chamber arrangement fitted into the frame portion 40 of the shoe 20, such arrangement including a pressure hose 44 situated in a groove space in the frame portion 40. The interior 45 of the pressure hose 44 is loaded by the pressure $P_{k1}$ of the pressure medium. A flexible glide plate 43 is provided above the hose 44 as illustrated, this glide plate 43 being supported on parts 41 and 42 of the frame portion 40. A grooved space 38 is also situated in the frame portion 40 for the recovery of lubricant fluid, just after the latter part 42 of the frame portion 40 in the running direction of the web W, as illustrated in FIG. 4. In all other respects, the structure of the press zone illustrated in FIGS. 4 and 5 is similar to the structure described above in connection with FIGS. 1–3.

The embodiment illustrated in FIG. 5 is also similar to FIG. 4 in all other respects, with the exception that four parallel pressure hoses 46*a*, 46*b*, 46*c* and 46*d* are fitted into the grooved space in the frame portion 40, instead of just one such pressure hose 44 as in FIG. 4. A flexible glide plate 43 is also disposed on the embodiment illustrated in FIG. 5, in similar fashion to FIG. 4. The outer face of this glide plate 43 rubs against the inner surface of the band or press belt 16. In accordance with FIG. 5, a feed pipe 28 for lubricant, which is provided with a nozzle slot 28', is disposed before the press zone. Lubricant, for example semiliquid fat, is fed through feed pipe 28 and nozzle slot 28', onto the inner face of the band or press belt 16.

After the pressure zone $\alpha$ in FIG. 5, two subsequent doctor blades 36 are disposed, being attached to parts 39 and 39' of frame portion 40, respectively. Lubricant is collected from the inner surface of the press belt 16 by action of these doctors against the same, and is passed into the grooved spaces 38, and out for recirculation (please note arrow $L_{out}$).

Figure 6:
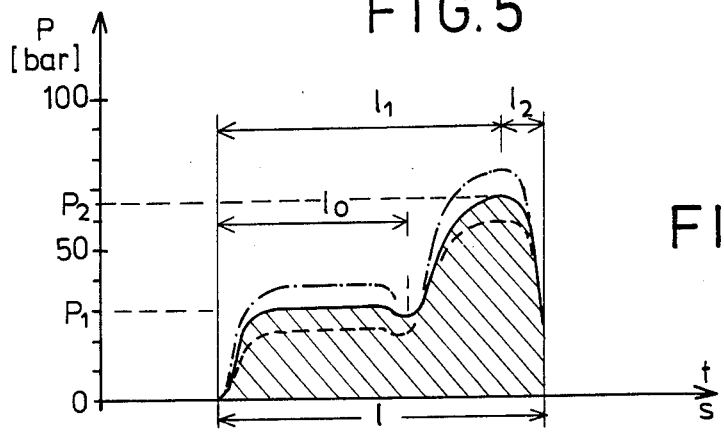
FIG. 6 is a graph illustrating distribution of compression pressure within the press zone of the long-press nips of FIGS. 4 and 5.

FIG. 6 illustrates the distribution of the compression pressure within the press zone $\alpha$ in the embodiments illustrated in FIGS. 4 and 5, in similar fashion to the graph of FIG. 3. The same notations are used in FIG. 6 as in FIG. 3.

A variable-crown roll or an adjustable-crown roll can be advantageously used as the counter-roll 10 in the press nip of the present invention, because such a roll can be more readily arranged so that it can withstand a sufficient load, as compared with an ordinary roll loaded at the ends thereof. The variable- or adjustable-crown roll is not necessarily required for the control of the transverse compression pressure profile.

Figure 7:
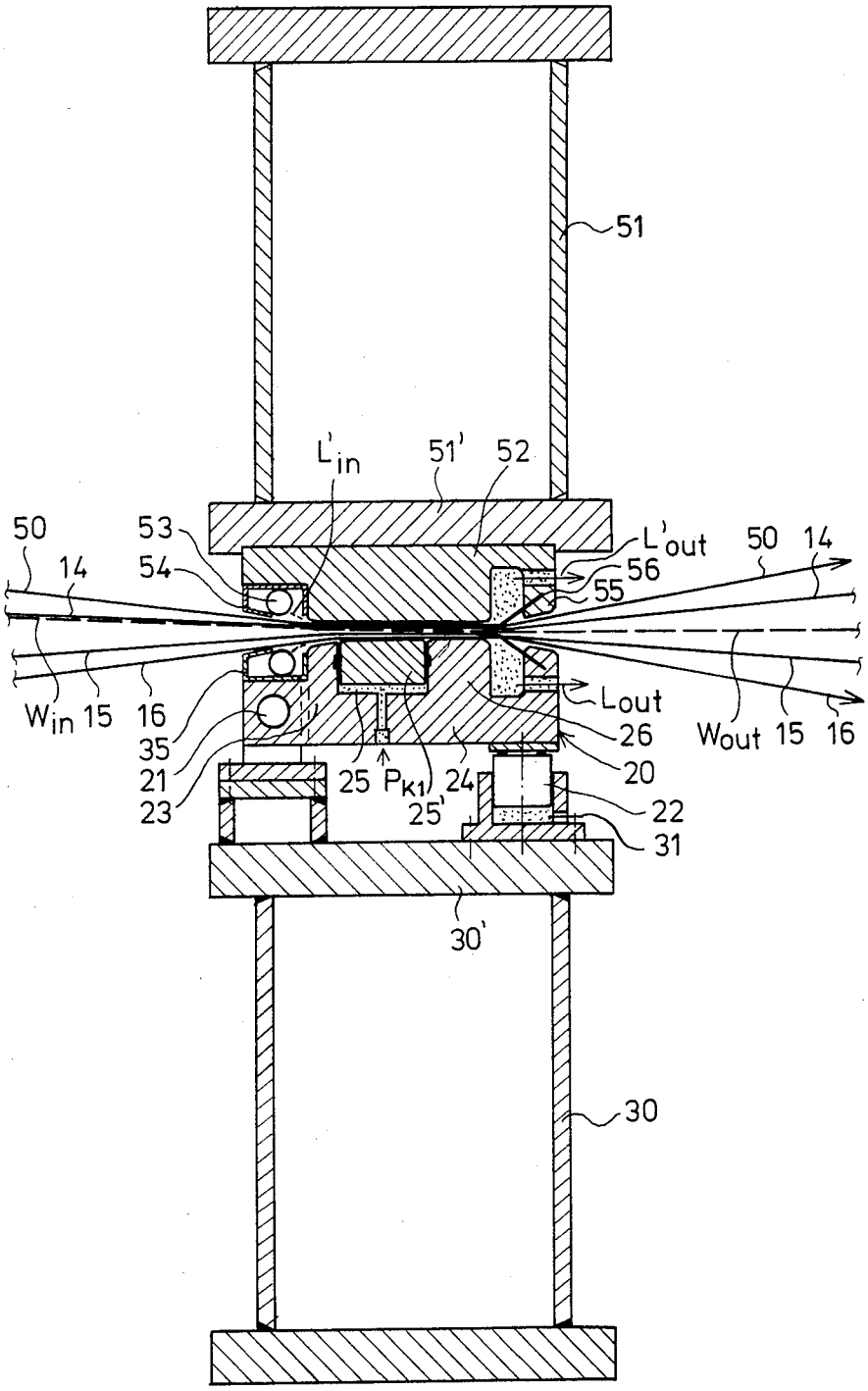
FIG. 7 illustrates another embodiment of the long-press nip of the present invention, in which the rotational counter-roll as illustrated in the embodiments of FIGS. 1–6 has been replaced by a stationary shoe and accompanying press band.

In the embodiment illustrated in FIG. 7, the press roll 10 described above is substituted with a stationary shoe member, which, together with a press shoe 20 of the type described above regarding the embodiments of FIGS. 1-6, forms the press zone. The press shoe 20 illustrated in FIG. 7 is similar to the press shoe illustrated in FIGS. 1 and 2, with similar parts being indicated by the same reference numerals. The stationary countershoe comprises a frame portion 52, with a press belt 50 being disposed to run with its gliding face placed against this press shoe 50. Lubricant is fed out of a pipe 53 placed inside a shield 54 (please see the dotted lines $L_{in}'$) at the inlet side of the press belt 50. Correspondingly, a doctor 56 is disposed at the outlet side of the stationary shoe on part 55, by means of which the lubricant is scraped off the face of the press belt 50 and fed for recirculation (please seen arrow $L_{out}'$).

The frame portion 52 of the stationary shoe 50 is attached to the lower flange 51' of the frame box 51 as illustrated. The structure and operation of the countershoe illustrated in FIG. 7, as well as the pressure distribution generated thereby, is substantially similar to the construction, operation, and generated pressure distribution in connection with the embodiments illustrated in FIGS. 1-6.

Figure 8:
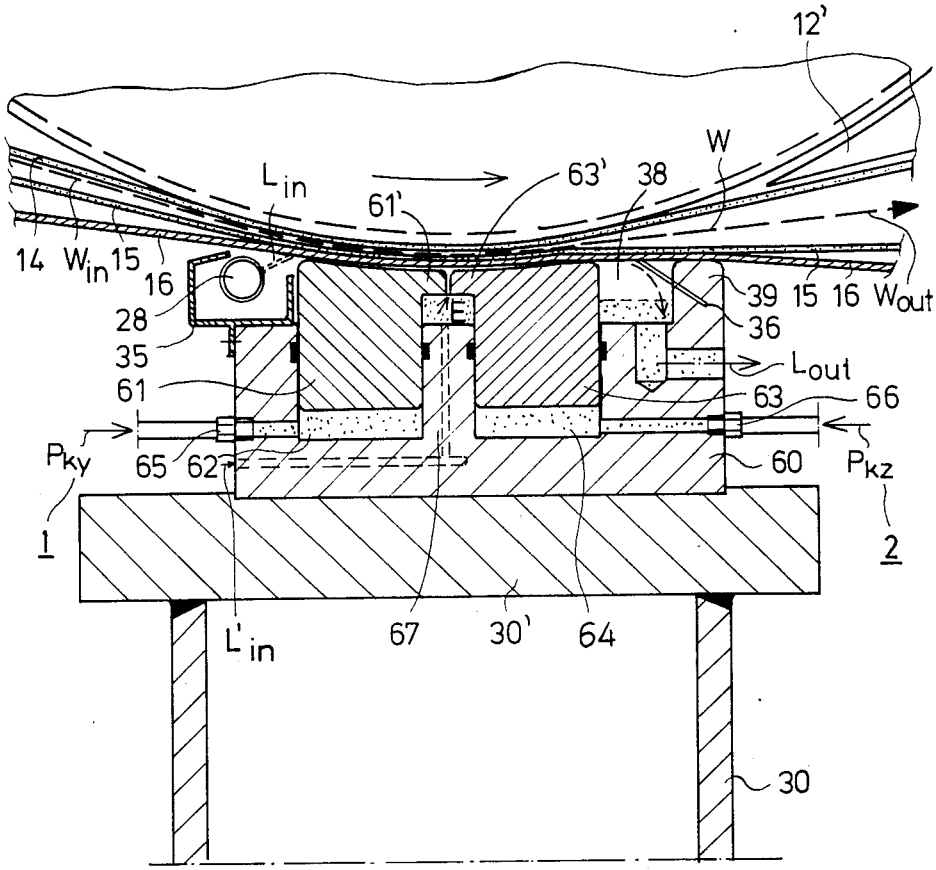
FIG. 8 illustrates a further embodiment of a press zone of the present invention, in which a movable, lower press shoe arrangement as disclosed in FIGS. 1–7 is replaced with a stationary press-shoe arrangement.

A further embodiment of the present invention is illustrated in FIG. 8, where an alternative press shoe arrangement is disposed. According to FIG. 8, the frame portion 60 of the press shoe is fitted onto the upper flange 30' of the lower frame 30. There are two groove spaces 62 and 64 disposed side by side in the frame portion 60, with a projection part 67 extending between these grooved spaces as illustrated. Pressure medium is fed through pipes 65 and 66 into the respective spaces 62 and 64, the pressures of these pressure mediums being denoted with $P_{ky}$ and $P_{kz}$ respectively. These individual pressures $P_{ky}$ and $P_{kz}$ can be adjusted separately, independently from one another.

Rib-shaped, sealed pistons 61 and 63 are disposed in the grooved spaces 62 and 64 respectively. These pistons 61 and 63 are provided with respective projecting portions 61' and 63' facing one another, with a small space E remaining between these projecting portions 61', 63', as illustrated in FIG. 8.

The feeding of lubricant to, and the removal thereof from the inner face of the press belt 16, takes place in similar fashion as described above. Moreover, lubricant can be fed for the glide face of the piston 63 through the space E and the inner conduits illustrated in phantom (please see the arrow $L_{in}'$).

Figure 9:
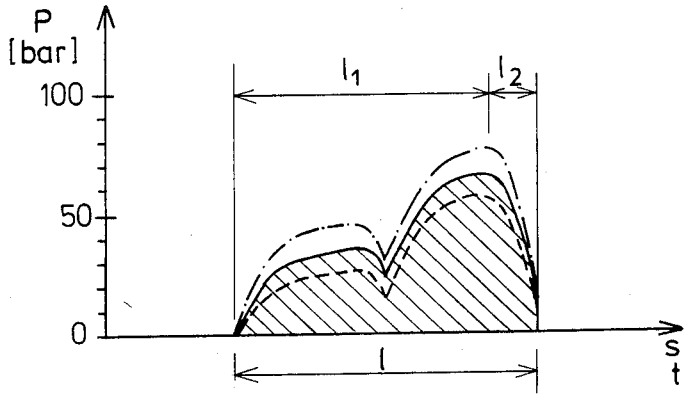
FIG. 9 illustrates the distribution of compression pressure within the press zone of FIG. 8.

FIG. 9 illustrates the distribution of the compression pressure in the press zone of the embodiment illustrated in FIG. 8. As is apparent from FIG. 9, the compression pressure distribution has two peaks, and increases in stepwise fashion, due to the fact that the individual pressures $P_{ky}$ and $P_{kz}$ are each separately adjustable.

Several variations are possible within the scope of the present invention. For example, press belt 16 passing over guide roll 17 may be replaced by a guided press ring arrangement as disclosed in PCT Appln. No. WO 82/02567, dated of publication Aug. 5, 1982.

The preceding description of the present invention is merely exemplary, and is not intended to limit the scope thereof in any way.

What is claimed is:

1. In a long-nip press, in which a press zone is formed between a counter-roll and a press-shoe arrangement or between a counter-shoe and the press-shoe arrangement, through which press zone a fibrous web passes between a felt and a press belt or between two press belts with the press shoe arrangment being disposed inside a loop of the press belt, said press including means for hydrodynamically lubricating the press belt by feeding lubricant thereon before the press zone, and means for receiving lubricant off the press belt after the press zone, the improvement comprising said press shoe arrangment comprises a frame component, means for articulately engaging said frame component with a stationary structure, a first shoe component disposed in said frame component, first pressure means for loading said first shoe component, disposed between said first shoe component and said frame component, a second shoe component formed as a part of said frame component, said second shoe component substantially immediately following said first shoe component in the direction of web run, second pressure means for loading said second shoe component, and said press shoe arrangement including means for increasing compression pressure applied by said first and second shoe components to the web in the press zone in one or more steps in a running direction of the fibrous web, and means for rapidly lowering the compression pressure applied to the web in the press zone from the maximum compression pressure applied therein to substantially no pressure.

2. The combination of claim 1, wherein said articulately engaging means extends substantially transversely to the running direction of the web, and said second pressure means for loading said second shoe component comprises at least one movable piston disposed between said frame component and the stationary structure.

3. The combination of claim 2, wherein said first shoe component is in the form of a rib-shaped piston disposed in a groove formed in said frame component extending substantially over the entire width of the running fibrous web and the press belt.

4. The combination of claim 2, wherein said lubricating means is disposed before said first shoe component in the running direction of the web and includes channel means for directing lubricant against an inside surface of the press belt, and said lubricant receiving means is disposed after said second shoe component in the running direction of the web, and includes at least one doctor blade for removing lubricant from the inside surface of the press belt, and at least one groove-like space situated in said frame component for recovering the lubricant removed from the inside surface of the press belt.

5. The combination of claim 2, wherein said first shoe component comprises at least one pressure hose disposed in a chamber formed in said frame component, and a flexible glide plate disposed between said at least one pressure hose and an inside surface of the press belt for acting against the same.

6. The combination of claim 2, wherein said first and second pressure means are independent of one another so that said first and second shoe components can be loaded independently from one another to increase the compression pressure applied to the web in the press zone in at least two steps.

7. The combination of claim 6, wherein said means for rapidly lowering the compression pressure constitutes means for lowering the same over a certain running distance of the web, and said means for increasing the compression pressure in the press zone constitutes means for increasing the same over a distance from about 3–6 times the certain distance.

8. The combination of claim 2, wherein said first pressure means constitutes means for increasing compression pressure in the press zone to a level of about 20–40 bar, and said second pressure means constitutes means for increasing pressure in the press zone to a level of about 50 to 80 bar.

* * * * *